United States Patent [19]

Saito et al.

[11] 4,221,958

[45] Sep. 9, 1980

[54] ELECTRONIC EQUIPMENT FOR ACCESSING BY KEY OPERATION

[75] Inventors: Seiji Saito, Yokohama; Taigan Shintani, Yotsukaido, both of Japan

[73] Assignee: Canon Kabushiki Kaisha, Tokyo, Japan

[21] Appl. No.: 841,208

[22] Filed: Oct. 11, 1977

[30] Foreign Application Priority Data

Oct. 28, 1976 [JP] Japan ..... 51-129844

[51] Int. Cl.[2] ..... G07C 1/10; G06M 3/06

[52] U.S. Cl. ..... 235/92 T; 235/92 GA; 235/92 DP

[58] Field of Search ..... 235/92 T, 92 GA, 92 EA, 235/92 TA, 92 DP; 340/323 R; 58/145 A, 24 A; 324/181, 186

[56] References Cited

U.S. PATENT DOCUMENTS

| | | | |
|---|---|---|---|
| 3,508,034 | 4/1970 | Toyama et al. | 235/92 T |
| 3,781,529 | 12/1973 | Abramson et al. | 235/92 T |
| 3,795,907 | 3/1974 | Edwards | 235/92 T |
| 3,876,867 | 4/1975 | Schull et al. | 235/92 T |
| 4,065,663 | 12/1977 | Edwards | 235/92 GA |
| 4,074,117 | 2/1978 | DeLorean et al. | 235/92 T |

*Primary Examiner*—Joseph M. Thesz

*Attorney, Agent, or Firm*—Fitzpatrick, Cella, Harper & Scinto

[57] ABSTRACT

An electronic equipment capable of keeping a plurality of lap times wherein upon depression of a start-stop key a time counting means is started and time being counted is displayed; upon each depression of a lap time key or button the contents in the time counting means at the instant the lap time key is depressed is transferred and stored in a respective register and the sequential order of the lap times stored is displayed; upon the second depression of the start-stop button the time counting means is disabled and the total time of one event counted is displayed; and thereafter upon each depression of the lap time button or key the lap times stored are sequentially displayed in the inverted order together with the sequential order of the lap time being displayed.

12 Claims, 2 Drawing Figures

ELECTRONIC EQUIPMENT FOR ACCESSING BY KEY OPERATION

BACKGROUND OF THE INVENTION

1. Field of the Invention

The present invention relates to an electronic equipment including a time counting means and more particularly an electronic equipment wherein in response to a first input signal entered by input means such as a key switch the contents of the time counting means is transferred to and stored in a memory and in response to a second input signal the contents in the memory is read out.

2. Description of the Prior Art

There are many races such as a swimming race in which a lap time has a significant meaning. For instance in a swimming race one time keeper must be assigned for each racer and must use a plurality of small-sized stop watches to keep the racer's lap time. Furthermore unless the time keeper is skilled in the art and has extensive experience, the correct measurement of a lap time is impossible.

SUMMARY OF THE INVENTION

In view of the above, one of the objects of the present invention is to provide an electronic equipment with which any unskilled time keeper may exactly register a plurality of lap times in succession in one race in a very simple manner.

Another object of the present invention is to provide an electronic equipment wherein in response to an external input signal; that is, upon depression of a key, the contents in a time counting means; that is, the time interval or a lap time counted is transferred and stored in a register; in like manner the succeeding lap times are sequentially stored; the number of lap times stored is displayed on a display panel; and after the total race time has been registered the stored lap times may be sequentially read out from the registers and displayed on the display panel together with the order of the lap time being displayed.

To the above and other ends, briefly stated the present invention provides an electronic equipment comprising an input means, a time counting means, a plurality of memory means, a means responsive to the signal from said input means for selecting at least one of said plurality of memory means and transferring and storing into said selected memory means the contents of said time counting means at the instant when said signal is received, and means for specifying said memory means into which is transferred and stored the contents in said time counting means.

The above and other objects, features and advantages of the present invention will become more apparent from the following description of one preferred embodiment thereof taken in conjunction with the accompanying drawings.

DESCRIPTION OF THE PREFERRED EMBODIMENT

Figure 1:
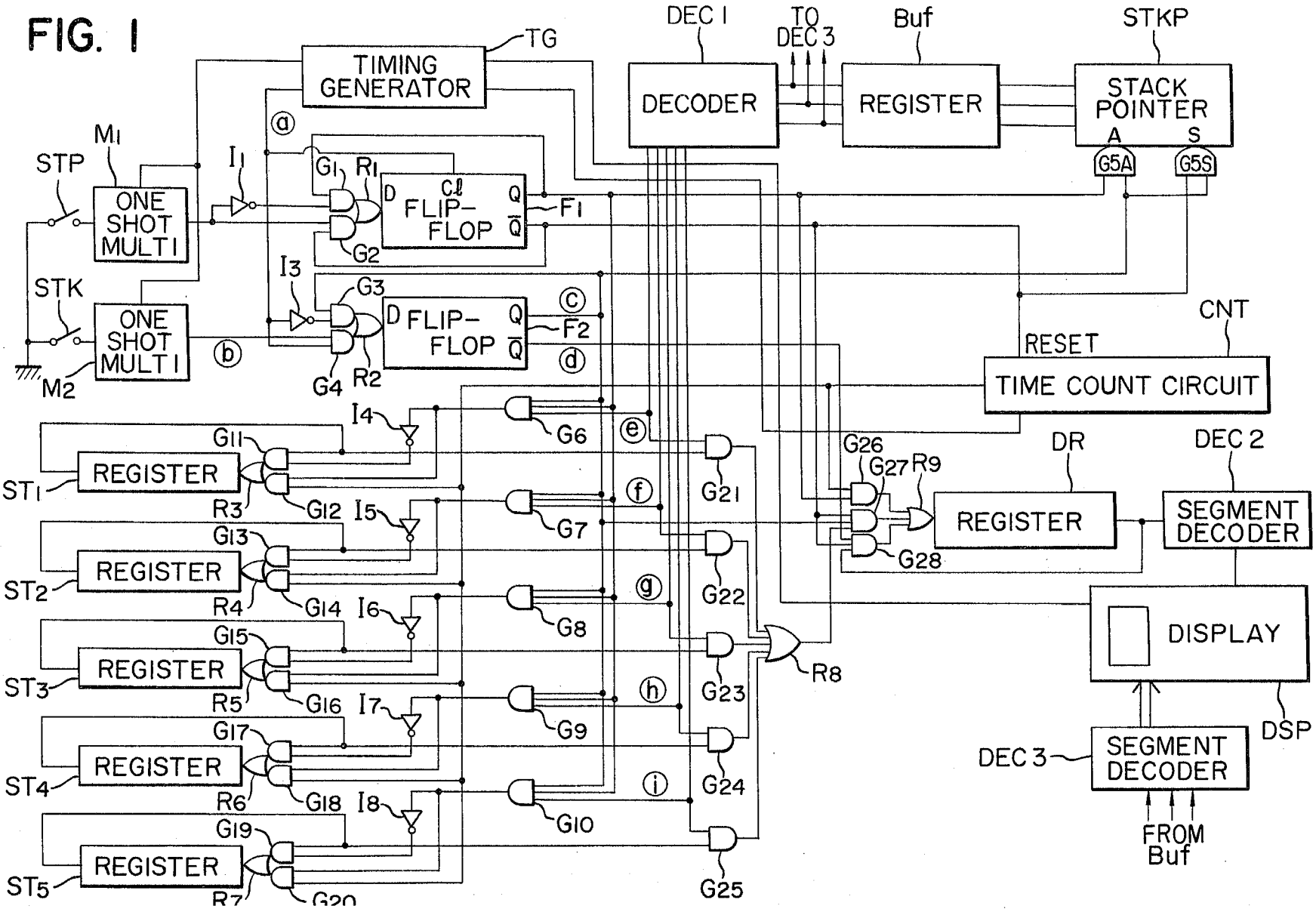
FIG. 1 is a block diagram of a preferred embodiment of an electronic equipment in accordance with the present invention.

Referring to FIG. 1, STP is a start-stop key; STK, a lap time register-read out key; G1–G28, AND gates; I1–I8, inverters; R1–R9, OR gates; F1, D flip-flop which is set or reset upon depression of the key STP; F2, D flip-flop which is turned on for a time interval equal to one word length upon depression of the key STK; TG, a timing pulse generator; M1 and M2, one shot multivibrators which generate the signal "1" for a time interval equal to one word length upon depression of the keys STP and STK; STKP, a stack pointer which increments or decrements the data consisting of three bits by "+1" or "−1" in response to the signal "1" from the flip-flop F2; Buf, a buffer register which stores the output from the stack pointer STKP; DEC1, a decoder which converts the three-bit signal transmitted through the buffer register Buf from the stack pointer STKP into "0 to 4"; CNT, a time counter which is set or reset in response to the $\overline{Q}$ signal from the flip-flop F1 for counting the pulses from the timing pulse generator TG thereby counting a time interval; ST1–ST5, registers for storing therein the time intervals counted by the time counter CNT; DR, a register for displaying the contents in the time counter CNT or register ST1–ST5; DSP, a display panel; DEC2, a segment decoder for displaying the contents in the register DR on the display panel DSP; DEC3, a segment decoder for displaying the contents in the stack pointer STKP on the display panel DSP.

Next the mode of operation will be described. It is assumed that the flip-flop F1 is initially reset. Upon depression of the key STP, the one shot multivibrator M1 generates the signal "1" for a time interval equal to one word length, and in response to this "1" signal and the "1" signal from the output $\overline{Q}$ of the flip-flop F1 AND gate G2 gives the signal "1" after it has received the timing pulse from the timing pulse generator TG. In response to this signal transmitted through OR gate R1 the flip-flop F1 is set.

In response to the reset of the one shot multivibrator M1 and the signal from the output Q of the flip-flop F1, AND gate G1 gives the signal "1" which is transmitted through OR gate R1 to the flip-flop F1 for maintaining it in the "set" state. In response to the output $\overline{Q}$ of the flip-flop F1 the time counter CNT starts counting a time interval. In response to the output Q of the flip-flop F1, the time interval counted by the counter CNT is transferred through AND gate G26 and OR gate R9 into the register DR, and the contents in the register DR is decoded by the decoder DEC2 and displayed on the display panel DSP.

Figure 2:
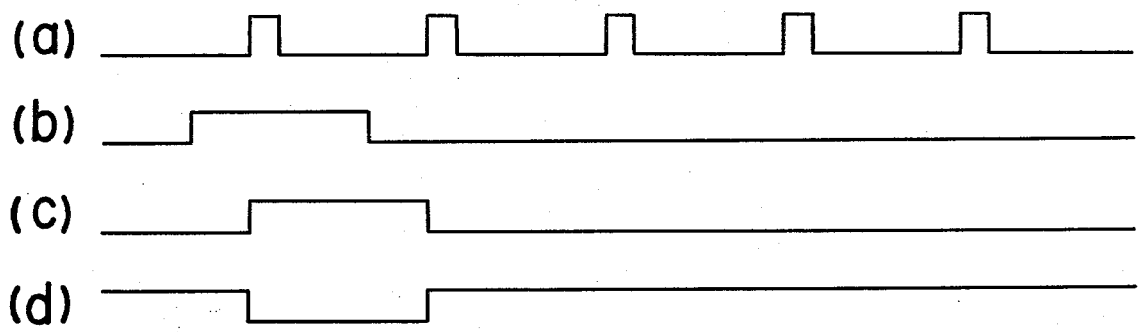
FIG. 2 shows various signal waveforms used for the explanation of the mode of operation thereof.

Upon depression of the key STK, the "1" signal from the one shot multivibrator M2 appears on a signal line b for a time interval equal to one word length as shown at (b) in FIG. 2. The timing pulses are shown at (a) in FIG. 2.

In response to one bit signal from the timing pulse generator TG AND gate G4 gives "1" signal which is transmitted through OR gate R2 to the flip-flop F2 to drive it into the "set" state. After one bit time and in response to the inverted signal on a signal line a and the output Q of the flip-flop F2 AND gate G3 gives "1" signal which in turn is transmitted through OR gate R2 to the flip-flop F2 to drive it into the "set" state for a time interval equal to one word length as shown at (c) in FIG. 2. Concurrently the stack pointer STKP changes its contents to "0", which in turn is decoded by the decoder DEC1 so that the signal "1" appears on a signal line e. In response to this "1" signal on the line e and the output Q of the flip-flop F1 and the signal on a signal line c, AND gate G6 gives the signal "1" so that the contents or the time interval registered by the time counter CNT is transferred through AND gate G12 and OR gate R3 into the register ST1 during a time interval equal to one word length.

During this step, the contents "0" in the stack pointer STKP is decoded by the decoder DEC3 and is displayed on the display panel DSP. In response to the signal on the signal line c and the next timing pulse, AND gate G6 gives the signal "0" so that the inverter I4 gives the signal "1". Thus the data transferred into the register ST1 through AND gate G11 and OR gate R3 is maintained. In response to the signal "1" on the signal line c and the output Q of the flip-flop F1 AND gate G5A gives the signal "1" for a time interval equal to one word length so that the contents in the stack pointer STKP is incremented by "+1". The contents "1" in the stack pointer STKP is decoded by the decoder DEC1, and the signal "0" appears on the signal line e while the signal "1" remains on the signal line f. Thereafter the contents "1" in the stack pointer STKP is decoded by the segment decoder DEC3 and is displayed on the display panel DSP together with the contents in the register DR.

Upon further depression of the key STK, the one shot multivibrator M2 gives the "1" signal for a time interval equal to one word length so that the flip-flop F2 is driven into the "set" state for a time interval equal to one word length. In response to the output Q of the flip-flop F1 and the signal on the signal line f AND gate G7 gives the signal "1". As a result, the contents in the time counter CNT is transferred into the register ST2 through AND gate G14 and OR gate R4 for a time interval equal to one word length. Thereafter the contents in the register ST2 is circulated through AND gate G13 and OR gate R4. In response to the signal "1" from AND gate G4, the contents in the stack pointer STKP is incremented by "+1" to "2" which is displayed in a manner substantially similar to that described above. The contents in the stack pointer STKP is converted by the decoder DEC1 so that the signal "0" appears on the signal line f while the signal "1" appears on the signal line g.

In like manner, every time when the key STK is depressed, the contents in the counter CNT is transferred into the register ST3, ST4 or ST5. However it should be noted when the key STK has been depressed five times, the contents in the stack pointer STKP changes to "0", and the contents in the counter CNT is transferred into the first register ST1.

Upon depression of the key STP, the one shot multivibrator M1 gives the signal "1" for a time interval equal to one word length so that the flip-flop F1 is reset and AND gates G1 and G2 give the "0" signals. In response to the output $\overline{Q}$ of the flip-flop F1 the time counter CNT is reset and AND gate G26 is closed which has been opened so as to transfer the contents in the time counter CNT into the register DR. In response to the output $\overline{Q}$ of the flip-flop F2 AND gate G28 for maintaining the contents in the register DR is opened so that the contents in the register DR is circulated through AND gate G28 and OR gate R9. The contents in the register DR representing a time interval from the time the key STP is depressed first to the time it is depressed second time is decoded by the segment DEC2 and is displayed on the display panel DSP.

Upon depression of the key STK, the one shot multivibrator M2 gives the signal "1" for a time interval equal to one word length so that the flip-flop F2 is driven into the "set" stage for a time interval equal to one word length. It is assumed that the contents in the stack pointer STKP be "4" at this stage. The contents "4" in the stack pointer STKP is decoded by the decoder DEC1 so that the signal "1" appears on the signal line i in response to which the contents in the register ST5 is transmitted through AND gate G25 and OR gate R9 to one input terminal of AND gate G27. In response to the signal from the output Q of the flip-flop F2 and the output $\overline{Q}$ of the flip-flop F1 AND gate G27 is opened so that the contents in the register ST5 is transferred through OR gate R9 into the register DR. The contents in the register DR is then decoded by the segment decoder DEC2 and is displayed on the display panel DSP. In response to the output $\overline{Q}$ of the flip-flop F1 and the output Q of the flip-flop F2 the signal "1" is applied to one input terminal s of the stack pointer STKP through AND gate G5S.

In response to this signal, the contents "4" in the stack pointer STKP is decremented by "−1" to "3" which in turn is decoded by the decoder DEC1 so that the signal "1" appears on the signal line h. The display of the contents in the stack pointer STKP changes from "4" to "3" so that one may confirm that the data being displayed is the contents in the register ST5.

In like manner, upon depression of the key STK, the contents in the register ST4, ST3, ST2 or ST1 is sequentially transferred into the register DR and is displayed on the display device DSP. It should be noted that when the contents "0" in the stack pointer STKP is decremented by "−1", the contents is "4". Therefore upon depression of the key STK after the contents in the register ST1 has been transferred into the register DR, the contents in the register ST5 is transferred into the register DR.

In summary, according to the present invention there is provided means which is responsive to the depression of one specified key for storing a time interval counted into a register or reading the contents in this register. Therefore a plurality of lap times in one race may be simply and instantaneously registered. Furthermore the contents in the stack pointer may be displayed so that one may specify the register the contents of which is being displayed. That is, one may confirm that the time data are being stored in the registers by the increase in contents in the stack pointer and that the time data are being read out of the registers by the decrease in the contents in the stack pointer.

So far the contents in the stack pointer has been described as being smaller than the number of the corresponding register by one (That is, when the time data is being stored into or read out from the first register, the contents of the stack pointer being displayed is "0" and so on), but a buffer register may be incorporated so that the contents in the stack pointer may coincide with the number of the corresponding register.

What we claim is:

1. Electronic equipment comprising:

a first key switch;

a second key switch;

signal producing means for producing a first signal responsive to a first operation of said first key switch, and for producing a second signal responsive to a second operation of said first key switch;

storage means having a plurality of addresses for storing data;

address signal generating means for generating a different address signal for every operation of said second key switch to sequentially advance the addressing of said storage means in one direction in response to the operation of said second key switch when the first signal from said signal producing means is produced, and to sequentially advance the addressing of said storage means in the reverse direction in response to the operation of said second key switch when the second signal from said signal producing means is produced;

means for causing said storage means to store data into the address indicated in accordance with the address signal from said address signal generating means, said means being operable in response to the operation of said second key switch when the first signal from said signal producing means is produced; and means for reading out the data stored in said storage means in accordance with an address signal from said address signal generating means, said means being operable in response to the operation of said second key switch when the second signal from said signal producing means is produced.

2. Electronic equipment according to claim 1, wherein said equipment further comprises a visualizing means for visualizing the content of said address signal generating means.

3. Electronic equipment according to claim 2, wherein said visualizing means also visualizes the content of said storage means which is indicated by the content of said address signal generating means.

4. Electronic equipment according to claim 1, wherein said address signal generating means generates the address signal to provide an increment of the address of said storage means in response to the operation of said second key switch when the first signal from said signal producing means is produced, and generates the address signal to provide a decrement of the address of said storage means in response to the operation of said second key switch when the second signal from said signal producing means is produced.

5. Electronic equipment according to claim 1 further comprising timing means for counting time intervals, wherein counting operations commence in response to the first signal from said signal producing means and terminate in response to the second signal from said signal producing means, and wherein said storage means stores the time data from said timing means.

6. Electronic equipment comprising:

time counting means for counting a time interval;

storage means having a plurality of addresses for storing the counting information of said time counting means;

a key switch for indicating the information to be written into said storage means;

address signal generating means for generating a different address signal for every operation of said key switch; and control means responsive to each repetitive operation of said key switch for causing said storage means to store the counting information of said time counting means into the address indicated in accordance with an address signal from said address signal generating means.

7. Electronic equipment according to claim 6, wherein said equipment further includes a visualizing means for visualizing the content of said address signal generating means.

8. Electronic equipment according to claim 7, wherein said visualizing means also visualizes the content of said storage means which is indicated by the content of said address signal generating means.

9. Electronic equipment comprising:

a first key switch;

a second key switch;

signal producing means for producing a first signal responsive to a first operation of said first key switch, and for producing a second signal responsive to a second operation of said first key switch;

time counting means for counting a time interval;

storage means having a plurality of addresses for storing the counting information of said time counting means;

address signal generating means for generating a different address signal for every operation of said second key switch to sequentially advance the addressing of said storage means in one direction in response to the operation of said second key switch when the first signal from said signal producing means is produced, and to sequentially advance the addressing of said storage means in the reverse direction in response to the operation of said second key switch when the second signal from said signal producing means is produced;

means for causing said storage means to store the counting information of said time counting means into the address indicated in accordance with an address signal from said address signal generating means, said means being operable in response to the operation of said second key switch once the first signal from said signal producing means is produced;

means for reading out the counting information stored in said storage means in accordance with an address signal from said address signal generating means, said means being operable in response to the operation of said second key switch when the second signal from said signal producing means is produced; and display means for visualizing the counting information of said time counting means in response to the first signal from said signal producing means, and for visualizing the content of said reading out means in response to the operation of said second key switch when the second signal from said signal producing means is produced.

10. An electronic equipment according to claim 9, wherein said time counting means starts the counting operation with the first signal from said signal producing means, and terminates the counting operation with the second signal from said signal producing means.

11. Electronic equipment according to claim 9, wherein said address signal generating means generates an address signal to provide an increment of the address of said storage means in response to the operation of said second key switch when the first signal from said signal producing means is produced, and generates the address signal to provide a decrement of the address of said storage means in response to the operation of said second key switch when the second signal from said signal producing means is produced.

12. Electronic equipment comprising:

a manual keyboard including means for manually selecting between a writing mode and a reading mode of the operation of the equipment, and including a key switch;

storage means having a plurality of addresses for storing data;

address means for generating a different address signal for every operation of said key switch to advance in sequence the addressing of said storage means in response to each repeated operation of said key switch in the writing and reading modes;

means responsive to the selecting of said writing mode for storing data into the address indicated in accordance with the address signal from said address means for every operation of said key switch;

means responsive to said reading mode for reading out the data stored in said storage means in accordance with the address signal from said address means for every operation of the key switch; and timing means for counting time intervals, wherein counting operations commence in response to the writing mode and terminate in response to the reading mode, and wherein said storage means stores the time data from said timing means.

* * * * *